US005148932A

United States Patent [19]

Orefice

[11] Patent Number: 5,148,932

[45] Date of Patent: Sep. 22, 1992

[54] MATERIALS-RECYCLING COLLECTION BIN ASSEMBLY

[76] Inventor: Richard Orefice, 64 Cherry Rd., Lake Hopatcong, N.J. 07849

[21] Appl. No.: 780,953

[22] Filed: Oct. 23, 1991

[51] Int. Cl.[5] ..... B65D 90/00

[52] U.S. Cl. ..... 220/23.2; 220/23.4; 220/23.83; 220/404; 220/529; 220/692; 220/693; 220/737; 220/909

[58] Field of Search ..... 220/23.2, 23.4, 23.83, 220/402, 404, 529, 692, 693, 737, 909, 62

[56] References Cited

U.S. PATENT DOCUMENTS

| | | | |
|---|---|---|---|
| 1,237,914 | 8/1917 | Kunath . | |
| 1,291,490 | 1/1919 | Haigh | 220/23.4 |
| 1,291,491 | 1/1919 | Haigh | 220/23.4 |
| 1,291,492 | 1/1919 | Haigh | 220/23.4 |
| 2,323,922 | 7/1943 | Langel | 220/23.2 |
| 2,514,364 | 7/1950 | Bates . | |
| 2,736,454 | 2/1956 | McConnell | 220/909 X |
| 3,236,405 | 2/1966 | Reil . | |
| 3,379,335 | 4/1968 | Mongelluzzo | 220/62 |
| 3,392,876 | 7/1968 | Allred . | |
| 3,815,778 | 6/1974 | Martin | 220/404 |
| 3,893,615 | 7/1975 | Johnson . | |
| 3,942,670 | 3/1976 | Mingus et al. | 220/23.4 |
| 4,121,710 | 10/1978 | Murphy . | |
| 4,416,373 | 11/1983 | de Larosiere | 220/23.4 X |
| 4,529,345 | 7/1985 | Van Gompel . | |
| 4,651,791 | 3/1987 | Evenson . | |
| 4,782,945 | 11/1988 | Geiler et al. | 220/737 X |
| 4,832,222 | 5/1989 | Storton . | |
| 4,834,253 | 5/1989 | Crine . | |
| 4,867,328 | 9/1989 | McCarthy . | |
| 5,028,740 | 7/1991 | Tomiya | 220/693 X |

FOREIGN PATENT DOCUMENTS

| | | |
|---|---|---|
| 0194339 | 8/1985 | European Pat. Off. . |
| 3024822 | 1/1982 | Fed. Rep. of Germany . |

*Primary Examiner*—Stephen Marcus
*Assistant Examiner*—Stephen Cronin
*Attorney, Agent, or Firm*—Bernard J. Murphy

[57] ABSTRACT

The Assembly has a base formed of a strip or sheet of plastic material which has a plurality of holes formed therein. Holes in ends of the sheet are aligned to receive fasteners to fix the sheet into a simple band. Other plastic sheets are turned into cylinders, which are set into the base, for the receipt therein of recyclable materials. The cylinders or sleeves are also formed of multi-holed sheets of plastic material. Again, sheet end holes are used, with fasteners, to fix the sleeves into their cylindrical form. Further ones of the holes are used to fix adjacent sleeves together, in the base, and some are used to fix the sleeves to the base. The Assembly can be provided as a rolled-up kit of the requisite holed sheets and a supply of fasteners.

4 Claims, 1 Drawing Sheet

FIG. 3
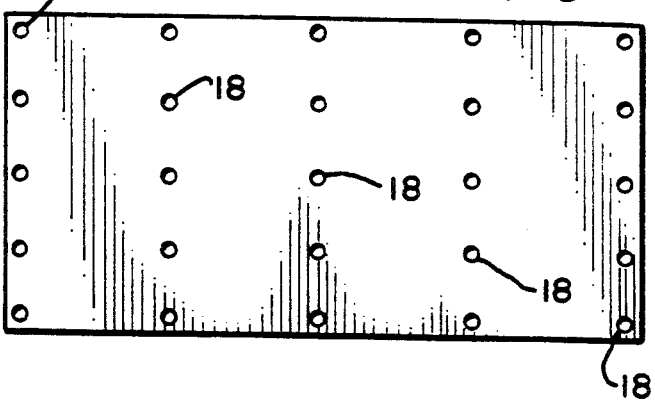
FIG. 4
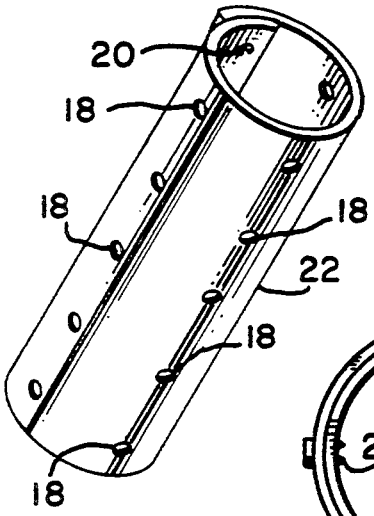
FIG. 2
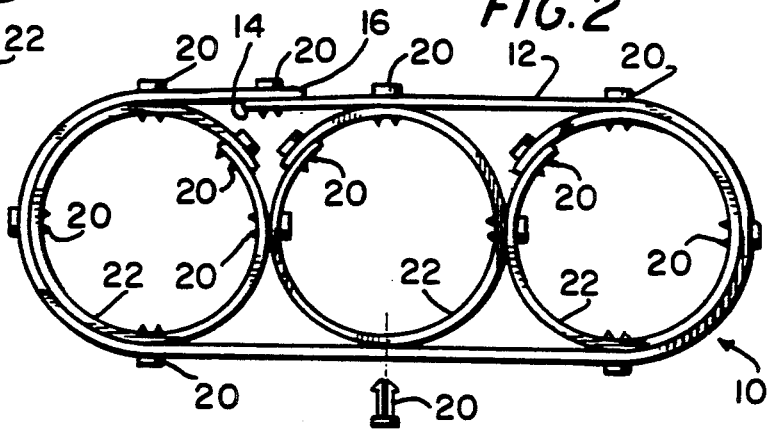
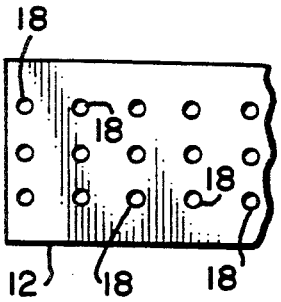
FIG. 5
FIG. 1
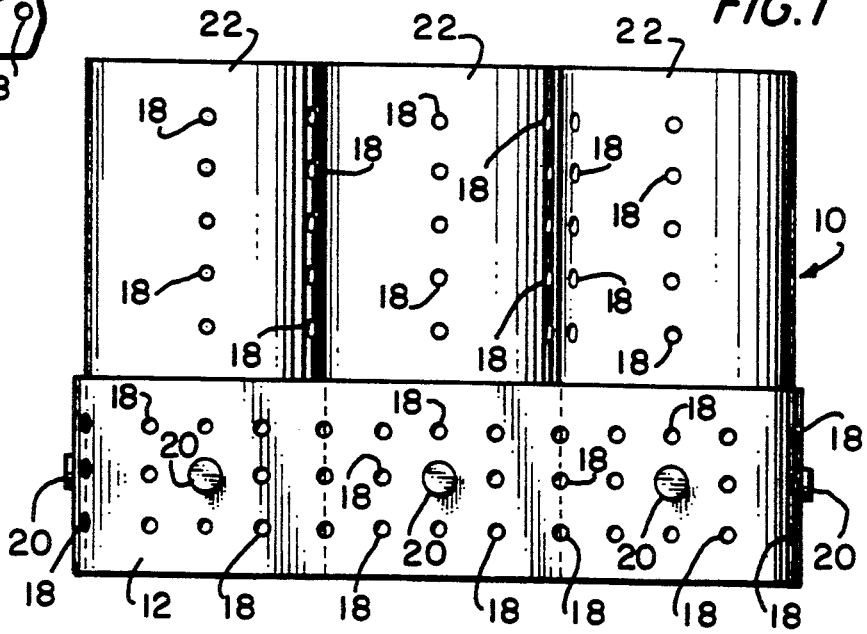

MATERIALS-RECYCLING COLLECTION BIN ASSEMBLY

This invention pertains to means for the collection of recyclable materials, and in particular to a novel materials-recycling collection bin assembly.

Refuse collection and disposal has become a monumental problem and, as a consequence thereof, cities and towns have mandated the collection of those materials which lend themselves to recycling. To this end, materials-recycling collection apparatus, in various embodiments, has appeared in the marketplace. Many of these are cumbersome, others are expensive to construct, and some are inadequate. What has long been needed is a meterials-recycling collection bin assembly of simple, inexpensive construction, and such an assembly which is, itself, formed of recyclable material.

It is an object of this invention to set forth just such a needed assembly. Particularly, it is an object of this invention to disclose a materials-recycling collection bin assembly comprising a base; and a plurality of collection bins set in said base, in juxtaposition and in parallel; wherein said bins comprise cylindrical sleeves, formed of plastic sheets having ends of said sheets coupled together; said sleeves are open at opposite ends thereof; said base, too, is formed of a plastic sheet which has ends thereof coupled together to define a simple band; said base has an open top and an open bottom; and said sleeves have a plurality of fastener-receiving holes formed therein for alignment of given ones of said holes, in each sleeve, with such holes in an adjacent sleeve for receiving fasteners therethrough (a) to secure such adjacent sleeves togeher, and (b) to provide some vertical stability, thereby, to such adjacent sleeves.

Further objects of this invention, as well as the novel features thereof, will become more apparent by reference to the following description taken in conjunction with the accompanying figures, in which:

FIG. 1 is a side elevational view of the novel assembly, according to an embodiment thereof;

FIG. 2 is a plan or top view of the FIG. 1 assembly;

FIG. 3 is a elevational view of a plastic sheet used to form one of the sleeves of the assembly;

FIG. 4 is a perspective view of one of the sleeves; and

FIG. 5 is a fragmentary view of a plastic strip or sheet used to form the base of the assembly.

As shown in the figures, the novel assembly 10 comprises a base 12 formed of a strip or sheet of plastic material which has ends 14 and 16 thereof coupled together to form a simple band. The base 12 has a plurality of holes 18 formed therein, and holes in opposite ends of the strip or sheet are aligned and fasteners 20 are fixed therein to hold the ends together.

The base 12 has a plurality (three, in this embodiment) of collection bins set therein, the same comprising cylindrical sleeves 22. The sleeves, too, are formed of plastic sheets, and these too have a plurality of holes 18 formed therein in rows and columns. Holes in end columns of the sheets are aligned together, and have fasteners 20 fixed therein to hold the ends together and fix the material into the cylindrical sleeves 22.

Some of the holes 18 in the base 12 are aligned with holes in the sleeves 22 which are set therein to fix fasteners 20 therein, this to secure the sleeves in the base 12. Still other holes 18 in adjacent sleeves 22 are aligned, to receive more fasteners 20. By this expedient, the abutting, contacting walls of the adjacent sleeves support each other and lend some vertical stability to each other.

It is an intention to provide the assembly in kit form, with the several sheets, for the base 12 and the sleeves 22, rolled up together into a single package, with a supply of fasteners 20, for the purchaser to set up his or her own materials-recycling collection bin assembly for clear glass bottles or jars, colored glass bottles or jars, paper, plastic jugs, alumninum, and the like.

Manufacture of the component sheets for the assembly 10 is quite simple. The same simply requires rolls of sheet plastic material which is unreeled therefrom, passed through a hole-punching operation, and then cut into lengths for the sleeves. Rolls of the material of one width would be used for the base strips or sheets, and rolls of greater width would be used for the sheets for the sleeves 22. Clearly, the strips or sheets cut for the bases 12 can be of varying lengths, to accommodate two, or three, or any practical number of sleeves 22. Too, toward conserving plastic, great multiplicities of holes 18 can be formed in the base and sleeve sheets, much like the holes in a sieve (with the punched out plastic being returned to sheet manufacture), such numbering far greater than those shown in the instant embodiment.

While I have described my invention in connection with a specific embodiment thereof, it is to be clearly understood that this is done only by way of example, and not as a limitation to the scope of the invention as set out in the objects thereof, and in the appended claims.

I claim:

1. A materials-recycling collection bin assembly, comprising:

a base; and a plurality of collection bins set in said base, in juxtaposition and in parallel; wherein said bins comprises cylindrical sleeves, formed of plastic sheets having ends of said sheets coupled together;

said sleeves are open at opposite ends thereof;

said base, too, is formed of a plastic sheet which has ends thereof coupled together to define a simple band;

said base has an open top and an open bottom; and said sleeves have a plurality of fastener-receiving holes formed therein for alignment of given ones of said holes, in each sleeve, with such holes in an adjacent sleeve for receiving fasteners therethrough (a) to secure such adjacent sleeves together, and (b) to provide some vertical stability, thereby, to such adjacent sleeves.

2. A materials-recycling collection bin assembly, according to claim 1, wherein:

said base has a plurality of fastener-receiving holes formed therein for alignment of given ones thereof with such aforesaid holes in said sleeves for receiving fasteners to secure said sleeves in said base.

3. A materials-recycling collection bin assembly, according to claim 1, wherein:

said sleeves have said holes formed therein in columns therealong and in rows thereabout; and each sleeve has two columns of holes in alignment, and fasteners fixed therein.

4. A materials-recycling collection bin assembly, according to claim 2, wherein:

said base has said holes formed therein in a row therealong;

said sleeves have said holes formed therein in rows thereabout; and given holes in said base are in alignment with holes in said rows thereof in said sleeves, and fasteners are fixed therein.

* * * * *